US005170423A

United States Patent [19]

Yurosko

[11] Patent Number: 5,170,423

[45] Date of Patent: Dec. 8, 1992

[54] INTRA ORAL DENTAL X-RAY PACKET

[76] Inventor: John J. Yurosko, 123 Shamrock Blvd., Venice, Fla. 34293

[21] Appl. No.: 847,611

[22] Filed: Mar. 5, 1992

[51] Int. Cl.[5] ..... H05G 1/28

[52] U.S. Cl. ..... 378/168; 378/165; 378/166; 378/205; 378/206

[58] Field of Search ..... 378/162, 165, 166, 168, 378/169, 204, 205

[56] References Cited

U.S. PATENT DOCUMENTS

| | | | |
|---|---|---|---|
| 4,108,308 | 8/1978 | Franke et al. | 378/169 |
| 4,791,657 | 12/1988 | Kirsch et al. | 378/169 |
| 4,922,511 | 5/1990 | Gay | 378/168 |
| 4,928,298 | 5/1990 | Tanaka | 378/162 |
| 5,034,974 | 7/1991 | Yurosko | 378/166 |
| 5,077,779 | 12/1991 | Steinhallsen, Jr. | 378/168 |
| 5,127,031 | 6/1992 | Yurosko | 378/166 |
| 5,127,033 | 6/1992 | Yurosko | 378/204 |

*Primary Examiner*—Constantine Hannaher
*Assistant Examiner*—Kim-Kwok Chu
*Attorney, Agent, or Firm*—Charles J. Prescott

[57] ABSTRACT

An improved intra oral dental x-ray packet structured to both prevent x-ray radiation from passing completely through the packet into the patient's mouth and to prevent x-ray exposure of a small transverse strip at one end of the unexposed x-ray film within the packet. The unexposed portion of the x-ray film is sized so as not to significantly reduce the useful area for tooth exposure, yet providing an area for imprinting as by light exposure patient identification indicia thereonto after x-ray radiation exposure, but prior to developing the exposed x-ray film.

1 Claim, 1 Drawing Sheet

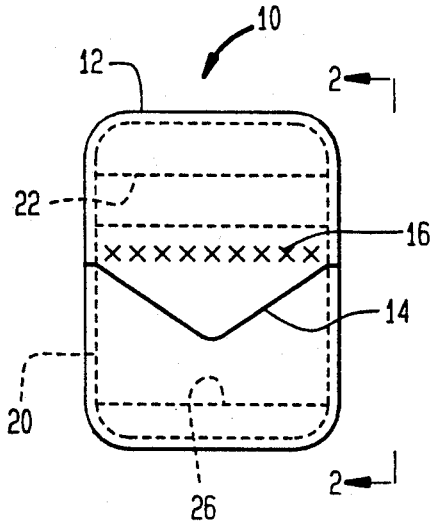
FIG. 1
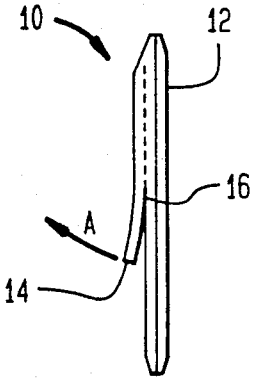
FIG. 2
FIG. 3
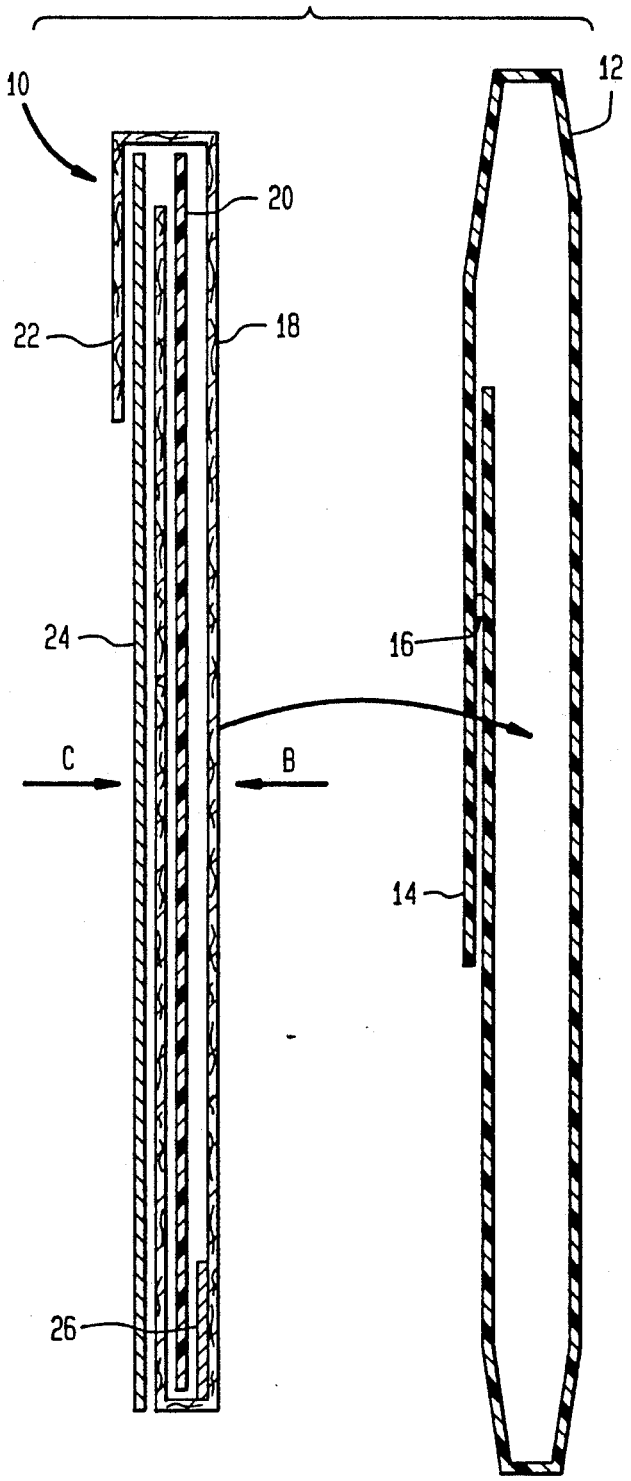

INTRA ORAL DENTAL X-RAY PACKET

BACKGROUND OF THE INVENTION

This invention generally relates to dental x-rays, and more particularly to an improved dental x-ray packet which includes an improved protective jacket containing an unexposed dental x-ray film which facilitates marking patient I.D. on each x-ray film.

Reference is made to my U.S. Pat. No. 5,034,974 directed to a dental x-ray patient identification marking device, to my pending application Ser. No. 07/689,228 which is directed to a dental x-ray patient identification camera and to my pending application Ser. No. 07/607,163, now U.S. Pat. No. 5,127,033, which is directed to, inter alia, an improved dental x-ray film and packet therefor.

Conventional methods of marking dental x-rays are as described in my above-referenced '974 patent wherein a conventional dental x-ray identification camera is utilized. The identification camera produces a focused light source for exposing the patient I.D. information onto a portion of exposed but undeveloped dental x-ray. This patient I.D. information, prior to the '974 patent was applied by simply manually aligning and arranging written indicia on a card with a portion of the x-ray film, a hit or miss procedure at best.

The '974 patent introduced a means for accurately locating and exposing patient I.D. indicia onto only a specific strip positioned transversely across one end of the dental x-ray film.

Although this arrangement is a significant improvement, nonetheless the patient I.D. indicia still remains somewhat less than clear and readable because the entire x-ray film has been initially exposed to x-ray radiation within the patient's mouth. The additional light source exposure produced by the identification camera against written or typed patient I.D. information to produce the additional x-ray image on the already x-ray irradiated film leaves an element of clarity and density to be desired in the patient I.D. information.

The present invention introduces a dental x-ray film packet which is improved in structure to prevent x-ray radiation from striking the transverse strip of the dental x-ray film during initial exposure within the patient's mouth. Thereafter, use of the I.D. camera as disclosed in the '228 application and the marking device as taught in the '974 patent may be more effectively utilized for producing sharper, easier to read patient I.D. information on each exposed and developed dental x-ray.

BRIEF SUMMARY OF THE INVENTION

This invention is directed to an improved intra oral dental x-ray packet structured to both prevent x-ray radiation from passing completely through the packet within the patient's mouth and to prevent x-ray exposure of a small transverse strip at one end of the unexposed x-ray film within the packet. The protected portion of the x-ray film is sized so as not to significantly reduce the useful area for tooth exposure, yet providing an area for imprinting, as by light exposure, patient identification indicia thereonto after x-ray radiation exposure, but prior to developing the exposed x-ray film.

It is therefore an object of this invention to provide an improved intraoral dental x-ray packet structured to facilitate imprinting patient identification information thereon.

It is another object of this invention to provide an improved intraoral dental x-ray packet structured to improve the readability of imprinted patient identification information thereon.

In accordance with these and other objects which will become apparent hereinafter, the instant invention will now be described with reference to the accompanying drawings.

BRIEF DESCRIPTION OF THE DRAWINGS

FIG. 1 is a front elevation view of the invention.

FIG. 2 is a side elevation view in the direction of arrows 2—2 in FIG. 1.

FIG. 3 is a partially exploded vertical section view of FIG. 2.

DETAILED DESCRIPTION OF THE INVENTION

Referring now to the drawings, the invention is shown generally at numeral 10 and includes a thin outer, pliable plastic jacket 12 formed by heat sealing mating panels around all edges as shown in FIG. 1. The jacket 12 also includes an openable flap 14 which is heat sealed in a closed position along 16. After initial x-ray radiation exposure while in a patient's mouth, to open the jacket 12, flap 14 is pulled in the direction of arrow A in FIG. 2.

The contents of jacket 12 are seen in FIG. 3 and include an elongated U-shaped envelope 18 formed of paper material and having an unsealed flap 22 formed across its upper end. This envelope 18 is open and unconnected along each upright margin thereof. Contained within the envelope 18 is a sheet of unexposed x-ray film 20 generally rectangular in shape and having curved corners as best seen in FIG. 1.

Disposed between flap 22 and the outer surface of envelope 18 is a protective thin lead sheet 24 having a shape similar to that of the x-ray film 20. This protective lead sheet 24 may be applied onto one surface of a sheet of paper or plastic in a conventional manner and serves to prevent x-ray reflective radiation from passing into the packet 10 in the direction of arrow C beyond the lead sheet 24 further into the x-ray film 20. The primary x-ray radiation producing desired dental images enters the packet 10 from the direction of arrow B after striking the patient's teeth.

The primary improvement of the present invention is embodied in an additional transverse lead strip 26 which is adhered to the inner surface of envelope 18 on the opposite side from the x-ray film 20 from protective lead sheet 24 so that x-ray radiation in the direction of arrow B against the packet 10 does not strike the area of x-ray film 20 covered by this second lead strip 26. Note that this lead strip 26 may also be applied onto the corresponding outer surface of envelope 18.

After the x-ray packet 10 has been placed into the patient's mouth and exposed to x-ray radiation, the exposed dental x-ray film 20 is then removed. Prior to developing, the exposed x-ray film 20 is then subjected to an intense light source as produced by the identification camera in a manner as set forth in my previous U.S. Pat. No. 5,034,974. This light source directed through a card containing written or typed patient I.D. indicia thereon, permanently exposes this indicia onto the x-ray film in the end region of the x-ray film previously protected from x-ray radiation by lead strip 26.

Thereafter, this dual x-ray and light-exposed x-ray film 20 is developed, whereupon a clear patient identification indicia is permanently imprinted across the transverse strip of the x-ray film 20 which was protected by lead strip 26.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An improved intra oral dental x-ray packet comprising:

a flat flexible sheet of unexposed x-ray film sized to fit into a patient's mouth and having a uniform generally rectangular shape;

a flat rectangular protective jacket for containing said x-ray film sandwiched between a first and second protective sheet similar in size and shape to said x-ray film;

a lead-coated x-ray barrier sheet also positioned within said jacket similar in size and shape to, and positioned against, an outer surface of said first protective sheet;

said second protective sheet having first and second edge margins and an upper and a lower margin;

an x-ray barrier strip disposed transversely across only a lower end of said second protective sheet, said x-ray barrier strip extending between said first to said second edge margins and upwardly from said lower margin toward but not to said upper margin thereof;

said x-ray film being protected from exposure to x-ray radiation only over a lower transverse strip of the surface thereof in alignment with said x-ray barrier strip when x-ray radiation is directed against said packet within the patient's mouth.

* * * * *